United States Patent [19]

Mahoney et al.

[11] Patent Number: 4,799,974

[45] Date of Patent: Jan. 24, 1989

[54] METHOD OF FORMING A FINE GRAIN STRUCTURE ON THE SURFACE OF AN ALUMINUM ALLOY

[75] Inventors: Murray W. Mahoney, Camarillo; Amit K. Ghosh, Thousand Oaks, both of Calif.

[73] Assignee: Rockwell International Corporation, El Segundo, Calif.

[21] Appl. No.: 54,558

[22] Filed: May 27, 1987

[51] Int. Cl.[4] ..... C22F 1/04

[52] U.S. Cl. ..... 148/12.7 A; 148/415

[58] Field of Search ..... 148/12.7 A, 415

[56] References Cited

U.S. PATENT DOCUMENTS 4,092,181 5/1978 Paton et al. ..... 148/12.7 A

*Primary Examiner*—R. Dean

*Attorney, Agent, or Firm*—H. Fredrick Hamann; Craig O. Malin

[57] ABSTRACT

An aluminum alloy is provided which has a surface with a fine grain structure. It is produced by overaging an aluminum alloy and then cold working only the surface by shot peening or other surface working technique. The alloy is then heated so that the overaged, cold-worked surface recrystallizes into a fine grain structure.

5 Claims, 1 Drawing Sheet

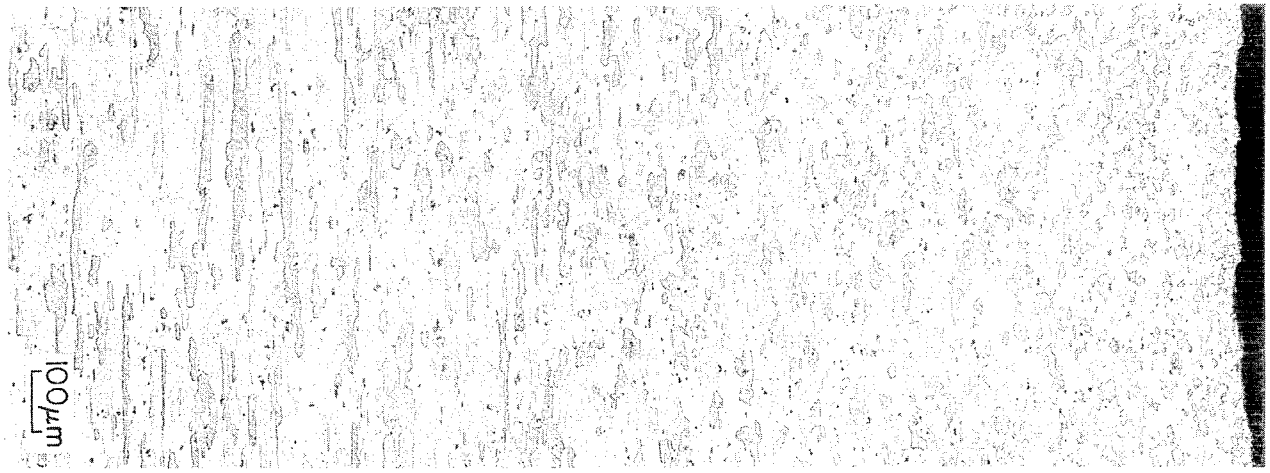
100μm

METHOD OF FORMING A FINE GRAIN STRUCTURE ON THE SURFACE OF AN ALUMINUM ALLOY

BACKGROUND OF THE INVENTION

This invention relates to the field of metallurgy and particularly to the field of processing precipitation hardenable aluminum alloys.

A prior art process for producing fine grain (less than about 10 μm) aluminum alloy is described in U.S. Pat. No. 4,092,181. Such process has been used to produce fine grain sheet, bar, forgings, and other forms which are plastically deformed to produce a fine grain throughout their thickness. However, fine grain cannot be readily produced in very thick sections using prior art processes because of the difficulty of providing the necessary deformation. Additionally, most aluminum alloy raw stock is still produced by conventional coarse grain methods.

In some applications it is desirable to have a fine grain at the surface of an aluminum alloy part, but it is not necessary to have a fine grain below the surface. For example in the case of exfoliation corrosion, a fine grain at the surface of a part should provide markedly superior corrosion resistance even through the center of the part is coarse grained. See for example the article "Characterization of Fine-Grained Superplastic Aluminum Alloys" by N. E. Paton, C. H. Hamilton, J. Wart, and M. Mahoney in Journal of Metals pp. 21–27, August 1982.

In some prior art processes the corrosion resistance of aluminum alloy parts is improved by shot peening or otherwise working the surface of the part to achieve a localized compressive stress state. However for high strength precipitation hardenable aluminum alloys, this approach may not be feasible because the protective residual stresses are relieved by the thermal treatments used after shot peening to achieve full strength.

Another prior art technique for improving the corrosion resistance of high strength aluminum alloys is to overage the alloy by heat treatment. Although the overaged material may have improved corrosion resistance, the overaging treatment lowers the strength of the material.

In addition to corrosion resistance, there are other surface-related phenomena which might be affected by grain size at the surface of the material. Such phenomena include surface finish after forming and fatigue crack initiation which originates at the surface. Thus, there is a need for aluminum alloys having a surface with a fine grain structure which is obtainable without a reduction in strength and which is obtainable regardless of the size of the part.

SUMMARY OF THE INVENTION

It is an object of the invention to provide an aluminum alloy with a surface having a fine grain structure.

It is an object of the invention to provide a method for reducing the grain size at the surface of an aluminum alloy without reducing its strength.

It is an object of the invention to provide a method for reducing the grain size at the surface of an aluminum alloy shape having a large cross section.

According to the invention, an aluminum alloy is provided which has small grains at the surface and larger grains in the interior below the surface. This grain structure is produced by overaging a precipitation hardening aluminum alloy. The surface of the overaged alloy is then plastically deformed by shot peening or other processes which cold works the surface without significantly working the center of the alloy. The alloy is then heated above its recrystallization temperature and the cold-worked material near the surface recrystallizes into a fine grain structure. The grains in the interior below the surface which are not cold worked do not recrystallize, but maintain their original large grain size.

These and other objects and features of the invention will be apparent from the following detailed description taken with reference to the accompanying drawing.

BRIEF DESCRIPTION OF THE DRAWING

FIG. 1 is a photomicrograph showing the grain size below the surface of type 7475 aluminum alloy processed according to the invention.

DESCRIPTION OF THE PREFERRED EMBODIMENT

The process of the invention is applicable to aluminum alloys which have precipitating constituents. These include the standard heat treatable alloys such as AA Designation: 2014, 2018, 2020, 2024, 2218, 2219, 2618, 4032, 6053, 6061, 6062, 6063, 6066, 6151, 7049, 7050, 7075, 7079, 7178, and 7475. The composition and standard heat treatments such as solution and precipitation hardening treatments for these alloys are known in the art and are found in publications such as U.S. Pat. No. 4,092,181 and the American Society for Metals Handbook which are incorporated herein by reference.

The aluminum alloy is then solution treated (if necessary) and overaged in accordance with the teaching in U.S. Pat. No. 4,092,181 to produce overaged precipitates to promote and control the growth of a fine grain structure during a later recrystallization step.

The term solution treatment refers to heating the material at a temperature and for a time sufficient to dissolve at least some of the precipitating constituents. The term precipitation hardening refers to heating the materials at time and temperatuees which give the alloy optimum strength properties. The term overaging refers to heating or aging the alloy at longer times and/or at higher temperatures than used for standard precipitation hardening.

After overaging, the material is plastically deformed. Rather than deforming the entire form or part as taught by the prior art, the plastic deformation is concentrated on the surface and extends only a short distance below the surface. The bulk of the material is undeformed, thus substantially maintaining the original shape of the part. Consequently, the process can be applied to machined parts. A convenient method of plastically deforming the surface (and the material just below the surface) without significantly deforming the center of the part is by shot peening. However, other methods of surface deformation such as roll peening can be used provided that the entire thickness or cross section of the part is not significantly deformed. As used in this patent, the term "surface deformation" refers to plastic deformation of the surface and the subsurface but not including any substantial plastic deformation of the center of the form or part.

The depth of the fine grain structure is determined by the depth of the plastic deformation produced in the material. When shot peening is used, the size of the shot, its velocity, and the time of peening will establish the depth of the fine grain structure.

After surface deformation, the material is heated to a recrystallization temperature. At the recrystallization temperature the overaged and plastically deformed surface and subsurface recrystallizes to a fine grain structure. However, the center of the material maintains its original large grain size and does not recrystallize because it is not plastically deformed. The minimum recrystallization temperature for severely worked aluminum alloys is over 600° F. A suitable recrystallization temprature for a particular alloy and process can readily be determined by empirical means.

After recrystallization, the aluminum alloy can be hardened to full strength using the conventional age hardening treatment for the particular alloy.

The following examples illustrate the invention as applied to precipitation hardening alloys of different compositions.

EXAMPLE 1

Aluminum Alloy 7475

An aluminum 7475 alloy plate one-half inch thick was selected to demonstrate the surface grain refinement process. The plate was solution treated at 900° F. for 1 hour and then overaged at 750° F. for 8 hours to coarsen the Cr- and Mn-rich dispersoid particles. The surface of the plate was then shot peened to provide the plastic deformation required for recrystallization. The plate was then heated to 900° F. for 30 minutes to recrystallize the plastically deformed surface and subsurface. Finally, the plate was aged to full strength by heating at 250° F. for 2 hours.

FIG. 1 is a photomicrograph showing the grain structure resulting from the above treatment. Small equiaxed grains extend from the surface of the plate (top of FIG. 1) to about 1000 μm below the surface where they change gradually into larger grain platelets. cl EXAMPLE 2

Aluminum Alloy 7075

Aluminum alloy 7075 is similar in composition and heat treatment to alloy 7475 described above. Consequently, if solution treated, overaged, shot peened, recrystallized, and age hardened as described for Example 1, the resulting microstructure should be similar to that shown in FIG. 1.

EXAMPLE 3

Aluminum Alloy 2219

Based upon the known heat treatment of alloy 2219, the following process should provide a part with a fine grain structure.

Solution treat the material at 990° F. for about 1 hour and quench in water. Overage the solution treated material in the range of 750° F. to 850° F. for 8 hours. Shot peen the overaged alloy and then recrystallize the shot peened material at 935° F. for 30 minutes.

EXAMPLE 4

Aluminum Alloy 2014

Based upon the known heat treatment of alloy 2219, the following Process should provide a part with a fine grain structure.

Solution treat the material at 935° F. for at least 20 minutes and quench. Overage at 600° F. to 800° F. Shot peen the overaged material and then recrystallize the shot peened material by heating the part at about 800° F.

EXAMPLE 5

Aluminum Alloy 6061

Based upon the known heat treatment of alloy 6061, the following process should provide a part with a fine grain surface.

Solution treat at 970° F. to 1000° F. and quench. Overage at 600° F. to 850° F. for 8 hours. Shot peen the overaged material and then recrystallize it by heating at 900° F.

Numerous variations can be made without departing from the invention. For example, material which has been previously solution treated or solution treated and aged can be directly overaged without requiring an additional solution treatment. Empirical tests within the skill of the artisan can be run to optimize the treatment for particular alloys and parts. Accordingly, it should be understood that the form of the invention described above is illustrative and is not intended to limit the scope of the invention.

What is claimed is:

1. A method of forming a fine grain structure on the surface of an aluminum alloy, comprising the steps of:

providing an aluminum alloy having a precipitating constituent;

overaging the aluminum alloy;

plastically deforming the surface of the aluminum alloy without significantly deforming the center of the aluminum alloy; and recrystallizing the surface of the aluminum alloy by heating it above its minimum recrystallization temperature.

2. The method as claimed in claim 1 wherein the step of plastically deforming the surface comprises shot peening the surface.

3. The method as claimed in claim 1 wherein the step of plastically deforming the surface comprises rolling the aluminum alloy under conditions which plastically deform its surface but do not significantly deform the entire thickness of the aluminum alloy.

4. The method as claimed in claim 1 wherein the step of overaging comprises:

heating the aluminum alloy to dissolve at least some of the precipitating constituents;

cooling the aluminum alloy; and heating the aluminum alloy at a temperature and time sufficient to overage it.

5. The method as claimed in claim 2 including the step of machining a surface on the overaged aluminum alloy, and wherein the step of shot peening comprises shot peening the machined surface.

* * * * *